US005205481A

United States Patent [19]

Dekker

[11] Patent Number: 5,205,481

[45] Date of Patent: Apr. 27, 1993

[54] LOCKED CASSETTE BILL BOX

[75] Inventor: Donald A. Dekker, Grand Rapids, Mich.

[73] Assignee: Rowe International, Inc., Whippany, N.J.

[21] Appl. No.: 788,809

[22] Filed: Nov. 7, 1991

[51] Int. Cl.[5] ..... B65D 91/00; G07B 15/00

[52] U.S. Cl. ..... 232/16; 232/1 D; 160/37

[58] Field of Search ..... 232/7, 15, 16, 1 D, 232/43.2; 160/19, 37, 26; 220/345; 206/214, 317

[56] References Cited

U.S. PATENT DOCUMENTS

| | | | |
|---|---|---|---|
| 1,107,985 | 8/1914 | Moskowitz . | |
| 2,593,190 | 4/1952 | Robin | 220/345 |
| 2,722,309 | 11/1955 | Waterman | 220/345 |
| 3,016,185 | 1/1962 | Osborne | 232/15 |
| 3,966,116 | 6/1976 | Dominick | 232/7 |
| 4,186,977 | 2/1980 | Gilovich | 232/15 |
| 4,341,100 | 7/1982 | Kohlhage | 232/15 |
| 4,434,931 | 3/1984 | Hunt | 232/15 |
| 4,638,746 | 1/1987 | Ishigure | 232/15 |
| 4,730,715 | 3/1988 | Siegenthaler | 232/15 |
| 4,807,736 | 2/1989 | Kondo | 194/206 |
| 4,834,230 | 5/1989 | Kondo | 194/206 |
| 4,949,901 | 8/1990 | Harris | 232/15 |
| 5,014,857 | 5/1991 | Kondo | 194/206 |
| 5,069,361 | 12/1991 | Jeffway | 206/214 |

*Primary Examiner*—Peter M. Cuomo
*Assistant Examiner*—F. Saether
*Attorney, Agent, or Firm*—Shenier & O'Connor

[57] ABSTRACT

A bill box assembly for use with an acceptor adapted to insert acceptable bills into the box through an opening in the box body which supports a door for movement between an open position at which bills can be inserted and a closed position over the opening. A spring loaded bolt locks the box onto the acceptor. A lever is biased to cause a hook on one end thereof to enter an opening in the door in the closed position thereof to lock the door while the other end of the lever releases the bolt. A key-operated lock is adapted to move the lever out of its door locking position. The box is molded in two parts which are assembled with the belt in position.

15 Claims, 4 Drawing Sheets

LOCKED CASSETTE BILL BOX

FIELD OF THE INVENTION

The invention is in the field of bill boxed associated with currency acceptors and relates more particularly to an improved locked cassette bill box.

BACKGROUND OF THE INVENTION

There are known in the prior art devices adapted to examine and accept genuine bills or currency notes. Associated with these bill acceptors are bill boxes which accumulate and store bills or notes which have been accepted.

Bill acceptors and associated bill boxes are installed in various locations. They may for example be used in conjunction with machines adapted to vend various articles. As is also known in the art, such installations are periodically visited by a route man to replenish the supply of articles in the machine. At the same time the route man may have the duty of retrieving money collected by the machine and returning it to the home office.

There have been developed a number of bill boxes or bill accumulators which, when assembled in a bill receiving position on a bill acceptor, are locked in that position. Such bill boxes are provided with means responsive to removal of a full box from an acceptor for preventing access to the bills within the box by the person carrying the box to the home office. This is accomplished by a key-operated lock on the box. When the box is returned to the office by the route man, a person having a key opens the box, removes the bills and restores the box to a condition at which it may be reassembled on an acceptor.

One example of a box of the type described is shown in Kondo et al U.S. Pat. No. 4,834,230. While the bill box shown therein successfully achieves the purpose of being locked to the acceptor while being filled with bills so as to prevent access to bills being accumulated and the purpose of preventing access to the bills once the box has been removed from the acceptor, it is relatively complicated and cumbersome in construction. Owing to its complexity, it is relatively expensive to manufacture.

SUMMARY OF THE INVENTION

One object of my invention is to provide an improved locked cassette bill box which is an improvement over bill boxes of the prior art.

Another object of my invention is to provide an improved normally locked cassette bill box which is relatively simple in construction.

Another object of my invention is to provide an improved locked cassette bill box which is certain in operation.

A still further object of my invention is to provide an improved locked cassette bill box which is relatively inexpensive to construct.

Other and further objects of my invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views.

DESCRIPTION OF THE PREFERRED EMBODIMENT

Figure 1:
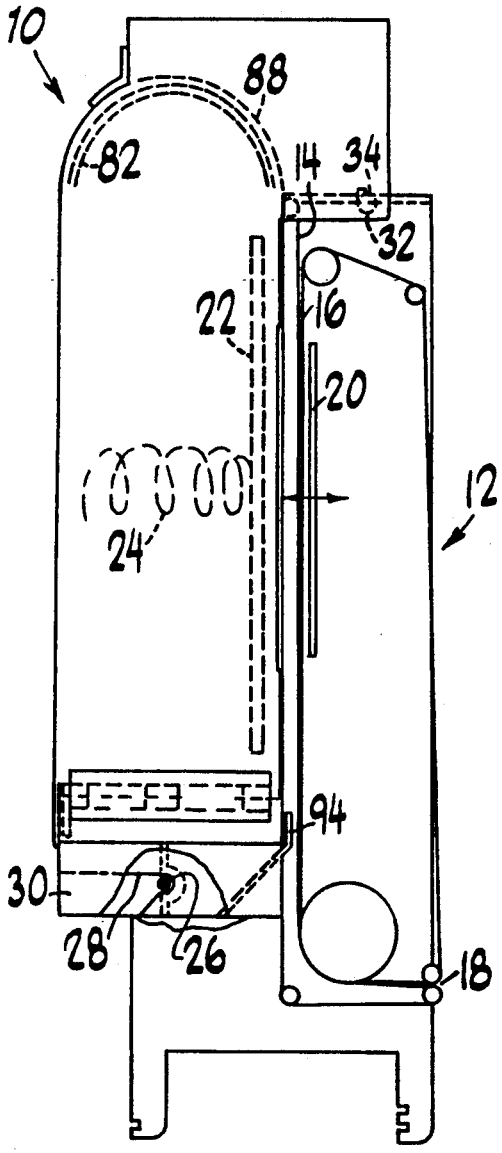
FIG. 1 is a side elevation of my improved bill box in use with a bill acceptor.

Referring now to FIG. 1, my improved locked bill box indicated generally by the reference character 10 is adapted to be used with a bill acceptor indicated generally by the reference character 12. The acceptor 12 may be of any suitable type known to the art. One form of acceptor 12 includes a pair of belts 14 and 16 which are driven to carry a bill inserted into the acceptor mouth 18 past a validating unit (not shown) to a position in front of a ram 20. As is known in the art, ram 20 is driven to move an acceptable bill from the acceptor 12 into the bill box 10 against a backing plate 22 biased into operative position by a spring 24. Since the details of acceptors such as the acceptor 12 are well known in the art, no detailed description thereof will be given.

The acceptor 12 is provided with a bar 26 adapted to be received in a recess 28 formed in the base 30 of the bill box 10. After the bar 26 has been received in the recess 28, the bill box 10 is swung in a clockwise direction as viewed in FIG. 1 around the axis of the bar 26 to the position shown in FIG. 1 in which a spring-loaded bolt 32 engages in a hole 34 in the top of the acceptor 12 to lock the bill box to the acceptor.

Figure 2:
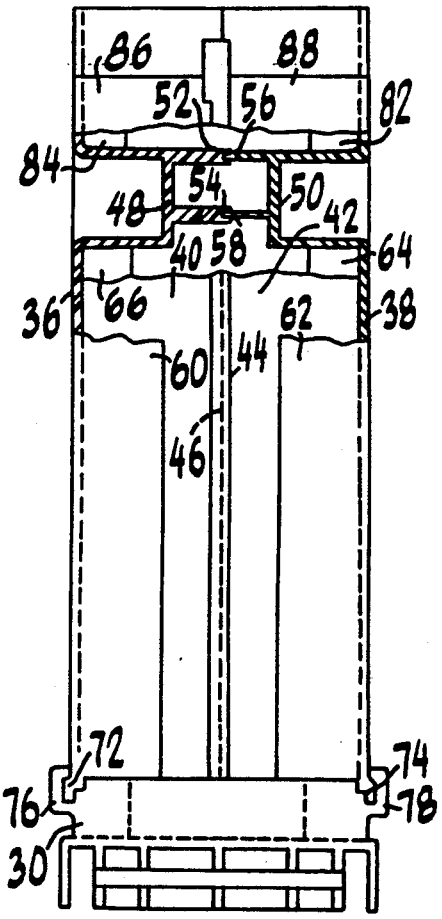
FIG. 2 a rear elevation of the improved locked bill box illustrated in FIG. 1 with parts removed, with other parts broken away and other parts shown in section.
Figure 4:
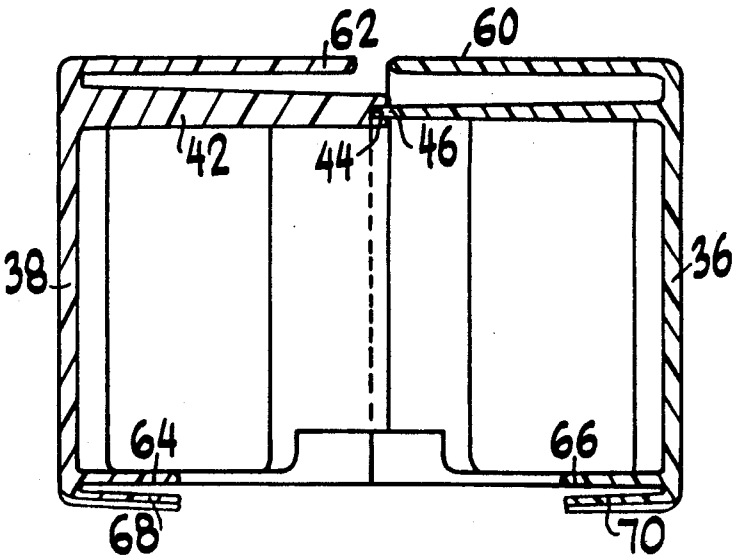
FIG. 4 is a sectional view of my improved locked bill box taken along the line 4—4 of FIG. 3.
Figure 3:
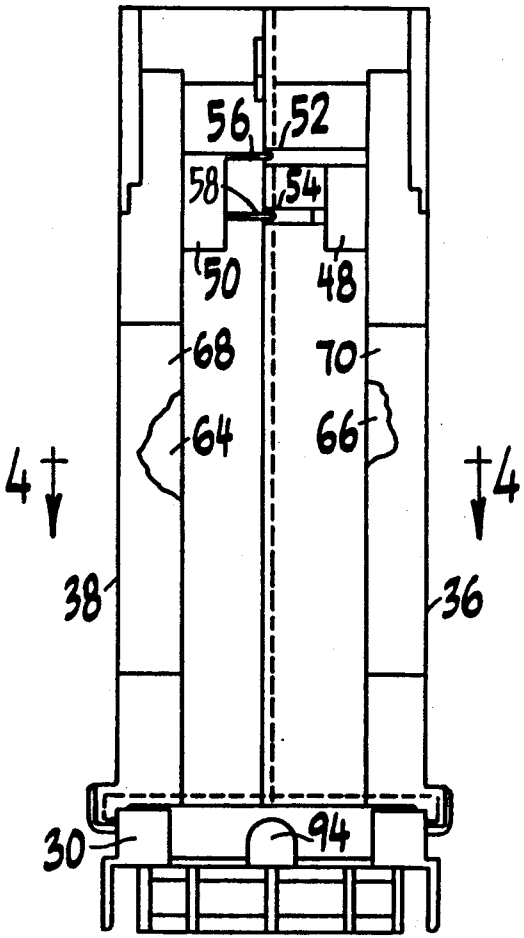
FIG. 3 is a front elevation of my improved locked bill box with parts removed and with other parts broken away.

Referring now to FIGS. 2 to 4, the bill box 10 is constructed in two halves, 36 and 38, which may be molded from a suitable synthetic resin such as an ABS polymer which is made by combining a styrene-acrylonitrile resin component with a butadiene-acrylonitrile resin in a manner known to the art. The two halves, 36 and 38, comprise respective lefthand and right-hand rear wall portions 40 and 42. The vertical edge of the wall portion 40 is formed with a groove 44 adapted to receive the edge 46 of the wall portion 42 when the parts 36 and 38 are assembled in a manner to be described hereinbelow.

I form the two halves 36 and 38 with cross portions 48 and 50. Portion 48 is provided with a pair of grooves 52 and 54 adapted to receive tongues 56 and 58 on the portion 50.

Halves 36 and 38 include respective rear belt-retaining flanges 60 and 62 disposed outside the respective back wall portions 40 and 42.

I provide the front of the box 10 with respective bill retaining flanges 64 and 66 and with respective front belt-retaining flanges 68 and 70 disposed outside the bill-retaining flanges 64 and 66.

The two halves 36 and 38 have respective guides 72 and 74 for receiving slides 76 and 78 formed on the base 30. In this way the base 30 is slidably mounted on the bottom of the box 10 for movement from an operative position at which it retains bills in the box to an inoperative position at which it permits the ready removal of bills from the box. Base 30 is molded from the same material as halves 36 and 38.

From the structure thus far described, it will be seen that flange 60 and back portion 40, flange 62 and back portion 42, as well as the pairs of flanges 64 and 68 and 66 and 70 are adapted to guide a belt to be described hereinbelow for vertical movement along the front and back of the bill box.

I provide continuations 82 and 84 of flanges 64 and 66 leading over the top of the box 10 to the wall portions 40 and 42. Respective top portions 86 and 88 of the parts 36 and 38 extend from the rear flanges 60 and 62 to the front flanges 70 and 68 complete the belt path.

I position a belt 80 within the belt path portions just described. This operation takes place as the two parts 36 and 38 are brought into operative relationship with the tongues 56 and 58 and the edge 46 cemented within the grooves 52, 54 and 44. Belt 80 is formed of any suitable flexible material such as polyprophylene.

I form belt 80 with a handle 90 which permits it to be moved readily between a position at which the box is open to receive bills and a position at which the box is closed to prevent the withdrawal of bills therefrom. In the open position, a belt limit stop 92 may engage top portions 86 and 88 to limit further movement of the belt in the open direction. In the closed position of the belt 80 the end of the belt carrying the stop 92 is disposed behind a tab 94 formed on the base 30. It will be seen that the handle 90 extends outwardly through the slot formed by the adjacent edges of the two flanges 60 and 62.

It will be appreciated that with the box 10 assembled on the acceptor 12, base 30 is locked in position. Further, when the belt 80 is moved to its closed position so that a portion of the belt is behind the tab 94, the base 30 cannot be separated from the body of the box 10. However, when the box 10 is disassembled from the acceptor 12 and the belt is moved to its open position, base 30 may readily be drawn free of the rest of the box 10 to facilitate removal of bills therefrom.

The portions of the two halves 36 and 38 above and to the left of belt guide portions 86 and 88 form a housing indicated generally by the reference character 96 for some of the operating parts of my bill box. The upper open end of the housing 96 normally is closed by a cover or a lid 98.

Housing 96 contains a cylinder 100 which receives the bolt 32 for sliding movement therein. A pin 102 on the bolt 32 rides in a slot 104 in a cylinder wall to limit the up and down movement of the bolt 32 in the cylinder 100. A spring 106 normally urges the bolt 32 downwardly to its locking position.

I pivotally mount a door locking lever 108 on a pin 110 in the housing 96. One end of lever 108 is provided with a pair of hooks 112 and 114 adapted to lock the door 80 in its closed position in a manner to be described hereinbelow.

Figure 5:
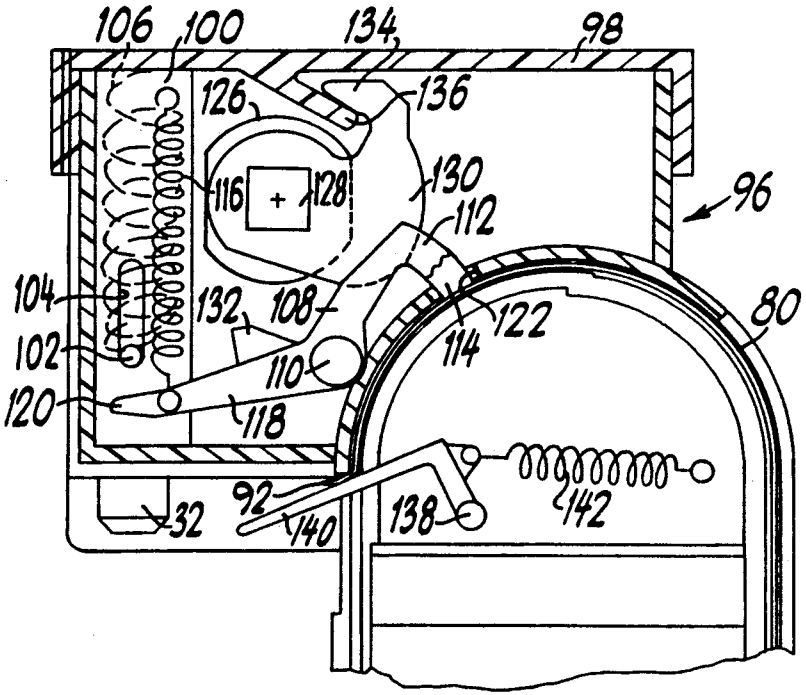
FIG. 5 is a fragmentary sectional view of my improved bill box illustrating the relative positions of the parts just prior to assembly, of the bill box on a bill acceptor.
Figure 7:
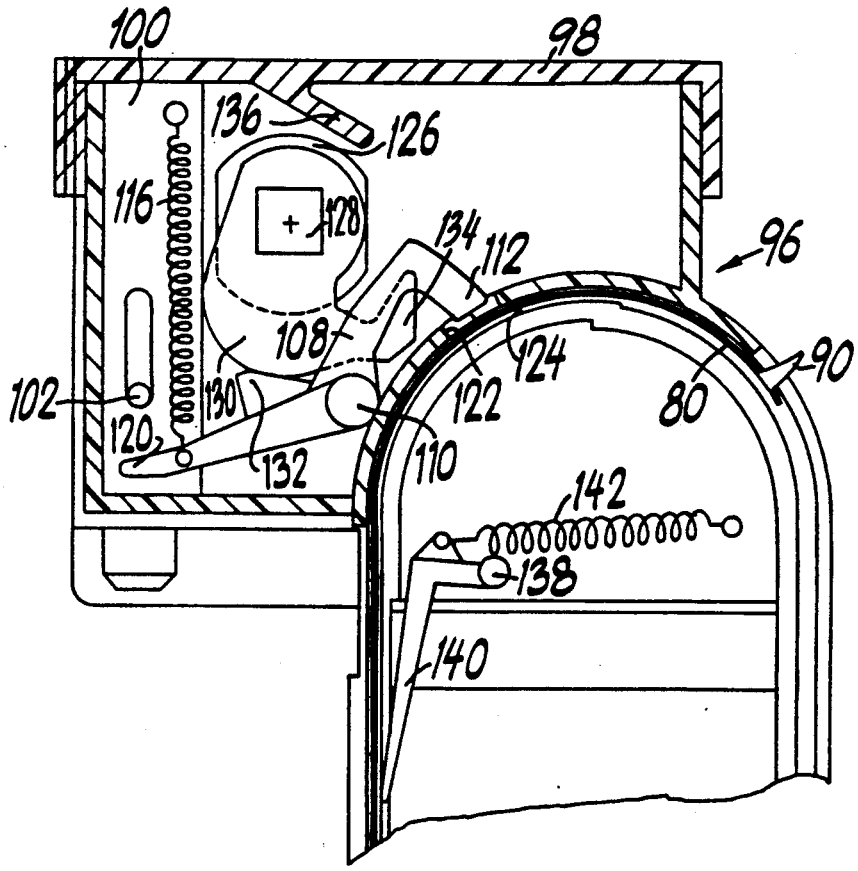
FIG. 7 is a fragmentary sectional view of my improved locked bill box conditioned for removal of the bills therefrom.

A spring 116 extending between a pin on the cylinder 100 and a pin on the arm 118 of lever 108 remote from the hooks 112 and 114 biases the lever 108 to rotate in a clockwise direction as viewed in FIGS. 5 and 7. I provide arm 118 with a tail 120 adapted to engage the pin 102 when lever 108 rotates in a clockwise direction to withdraw the bolt 38 from operative engagement with the acceptor 12, thus to release the bill box from the acceptor.

Each of the portions 86 and 88 has an opening 122 through which one of the hooks 112 or 114 moves under the action of spring 116. I provide the belt 80 with a pair of openings 124 adapted to register with the openings 122 when the door 80 is in its closed position.

Housing 96 also contains a key operated lock 126 having a shaft 128 which rotates when the lock is opened or closed. Shaft 128 carries for rotation therewith a cam 130. When the lock is moved from its locked condition illustrated in FIGS. 5 and 6 to its unlocked condition illustrated in FIG. 7, shaft 128 and cam 130 rotate in a clockwise direction as viewed in the Figures. In the course of this movement, the cam 130 engages a boss 132 on arm 118 to pivot the lever 108 in a counterclockwise direction as viewed in FIGS. 5 to 7. I provide cam plate 130 with a hook 134 adapted to engage a projection 136 on the underside of cover 98 to hold the cover onto the housing when the lock is in its locked condition.

A pivot pin 138 supports a right angle arm 140. A spring 142 normally urges the arm 140 to a position at which it engages the stop 92 or aligned edges of portions 86 and 88 when the belt is in its open position. As the belt 80 is moved to its closed position, it pivots the arm 140 against the action of spring 142 in a counterclockwise direction as viewed in FIGS. 5 to 7 to move the upper edges of bills in the box 10 out of the path of the leading edge of the door 80.

In operation of my improved locked cassette bill box, prior to its assembly on an acceptor 12, the parts occupy the relative positions illustrated in FIG. 5. In that position of the parts the position of lock 126 is such that hook 134 engages projection 136 to lock cover 98 onto housing 96. Lever 108 is in a position at which the ends of the hooks 112 and 114 ride on the outer surface of the door 80. It will be appreciated that in this position of the parts, the door 80 is open with the stop 92 in engagement with the underside of housing 96.

In order to assembly the box 10 on the acceptor 12, the lower end of the box first is manipulated so as to bring the recess 28 in operative relationship with the rod 26. The box 10 then is rotated in a clockwise direction as viewed in FIG. 1 until the bolt 32 engages in the hole 34 in the upper end of the acceptor 12.

In the operative position of the bill box just described, the door 80 is open and the box is locked on the acceptor by the bolt 32. It will readily be appreciated that in this relative position of the parts the base 30 cannot be separated from the body of the box 10.

When the box 10 is filled with bills or at any other time it becomes desirable to remove the box 10 from the acceptor, handle 90 of door 80 is operated to move the door to a position at which it closes the opening between flanges 68 and 70. In the course of its movement from the open to the closed position, either stop 92 or the leading edge of the belt 80 pivots the element 140 in a counterclockwise direction as viewed in FIGS. 5 to 7. This member thus moves the upper edges of bills which might otherwise be bulging out of the space between flanges 64 and 66 out of the path of the leading edge of the door. This prevents jams and facilitates movement of the door to the closed position.

When the door arrives in its fully closed position, spring 116 pivots lever 108 in a clockwise direction to move the hooks 112 and 114 through the openings 124 in the door 80 to lock the door in its closed position. At the same time the tail 120 moves pin 102 upwardly against the action of spring 106 to move the bolt 32 out of the hole 34 so that the box 10 can be separated from the acceptor 12 by rotating it in a counterclockwise direction as viewed in FIG. 1 and disengaging recess 28 from the rod 26.

Figure 6:
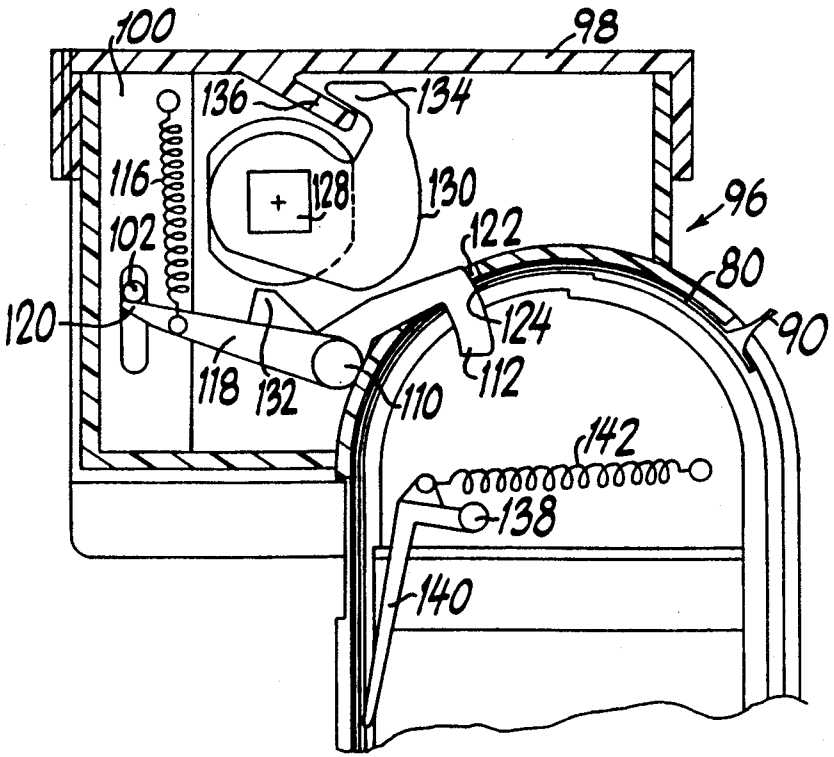
FIG. 6 is a fragmentary sectional view of my improved bill box just after its removal from the bill acceptor.

It will be remembered that when the door 80 is moved to its closed position the lower end thereof is disposed behind the tab 94 on the base 30 so that the base cannot be removed from the body of the box. The relative position of the parts with the door 80 closed is illustrated in FIG. 6.

When the locked box has been returned to the home office, the person having possession of the key for operating lock 126 opens the lock. In the course of this movement cam 30 rotates in a clockwise direction as viewed in FIG. 7 to engage the projection 132 to rotate lever 108 to the door release position illustrated in FIG. 7. The door 80 can now be moved to the open position at which the base 30 is freed to be slid off the bottom of the box 10 to permit removal of the bills therefrom.

Further, in the release position illustrated in FIG. 7, tail 120 releases pin 102 so that bolt 32 is restored to its locking position by the spring 106.

In the position of the parts illustrated in FIG. 7, hook 134 is out of engagement with the projection 136 so that cover 98 can be removed. Removal of the cover 98 permits the lock 126 to be changed if desired.

Before returning the box to the route man for reinstallation on an acceptor, lock 126 is operated to bring the hook 134 into engagement with projection 136 to lock the cover 98 onto the housing 96. This is the position of the parts illustrated in FIG. 5 in which the box 10 is in condition to be applied to an acceptor 12.

It will be seen that I have accomplished the objects of my invention. I have provided an improved locked cassette bill box which overcomes the defects of bill boxes of the prior art. My bill box is relatively simple in construction. It is certain in operation. It is relatively inexpensive to manufacture.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A bill box assembly adapted to be brought into operative relationship with a bill acceptor adapted to insert acceptable bills into said box through an opening therein, said assembly including in combination a box body formed with an opening through which bills can be inserted, a door, means mounting said door on said box body for movement between an open position at which bills can be inserted through said opening and a closed position over said opening, means on said body for locking said bill box to an acceptor, a lever, means mounting said lever on said body for pivotal movement around a point intermediate its ends between a first position and a second position, said door being free to move and said locking means being operative in said first position of said lever, first interengageable means on one end of said lever and on said door for preventing movement of said door in the second position of said lever and second interengageable means on the other end of said lever and on said locking means for rendering said locking means inoperative in the second position of said lever.

2. An assembly as in claim 1 including means for biasing said lever to said second position.

3. An assembly as in claim 2 in which said means for preventing movement of said door comprises a hole in said door and a hook on said one end of said lever.

4. An assembly as in claim 3 in which said locking means comprises a bolt and means for biasing said bolt to locking position, said second interengageable means comprising said other end of said lever and an element on said bolt.

5. An assembly as in claim 4 including a key-operated lock for moving said lever from said second position to said first position.

6. An assembly as in claim 5 in which said body comprises a housing having an open top, said lock being disposed in said housing, a cover for said housing and means operated by said lock for securing said cover on said housing.

7. An assembly as in claim 1 including a key-operated lock for moving said lever from said first position to said second position.

8. An assembly as in claim 1 in which said box body has an open bottom, a base, means mounting said base on said body for sliding movement over said bottom opening and means on said door in the closed position thereof for retaining said base in position over said bottom opening.

9. An assembly as in claim 1 in which said door is a flexible belt, said belt being provided with an externally accessible handle for moving said belt between said positions.

10. An assembly as in claim 1 in which said box body is made up of two halves molded from a suitable synthetic resin.

11. An assembly as in claim 10 in which each of said halves is formed with a box back portion, a rear door-retaining flange relatively closely spaced from said back portion, a front bill-retaining flange and a front door-retaining flange relatively closely spaced from said bill-retaining flange, said door being a flexible door and means for joining said box body halves with said belt disposed between said back portions and said rear-retaining flanges and between said bill-retaining flanges and said front belt-retaining flanges.

12. An assembly as in claim 11 in which said rear belt-retaining flanges are outboard of said back portions, said belt being formed with a handle extending outwardly between said rear belt-retaining flanges.

13. A generally rectangular bill box for receiving bills from an acceptor including in combination first and second box body halves molded from a synthetic resin, each of said halves forming a box body side having opposite edges, a box back part extending inwardly from the side along one edge, a front bill-retaining flange extending inwardly from the side for a shorter distance than side back part along the other edge of said side, a rear belt-retaining flange closely spaced from said back part and a front belt-retaining flange closely spaced from said bill-retaining flange and of approximately the same inward extent, a flexible belt and means for assembling said halves with said back parts meeting to form a closed back and with said front flanges forming a bill insertion opening through which bills from said acceptor may be inserted to be retained by said bill-retaining flanges a upper portion of each of said halves is formed with a housing half, said housing halves cooperating to form a housing having an open top, and a cover for said open top.

14. A bill box as in claim 13 in which each of said halves is formed with a base-receiving track, said box including a base and slides on said base received by said tracks.

15. A bill box as in claim 13 in which each of said halves is formed with a base-receiving track, said box including a base and slides on said base received by said tracks.

* * * * *

UNITED STATES PATENT AND TRADEMARK OFFICE

CERTIFICATE OF CORRECTION

PATENT NO. : 5,205,481

DATED : April 27, 1993

INVENTOR(S) : Donald A. Dekker

It is certified that error appears in the above-identified patent and that said Letters Patent is hereby corrected as shown below:

In the Claims:

Claim 13, col. 6, line 63, change "side" to --said--.

Claim 13, col. 7, line 4, after "flanges" insert --,--.

Signed and Sealed this

Seventh Day of December, 1993

*Attest:*

*Attesting Officer*

Bruce Lehman

BRUCE LEHMAN

*Commissioner of Patents and Trademarks*